United States Patent [19]

Blasberg et al.

[11] 4,297,858

[45] Nov. 3, 1981

[54] HIGH DENSITY PILE WARE AND THE PROCESS THEREFOR

[75] Inventors: Helmar Blasberg, Obertshausen; Christian Wilkens, Heusenstamm, both of Fed. Rep. of Germany

[73] Assignee: Karl Mayer Textilmaschinenfabrik GmbH, Obertshausen, Fed. Rep. of Germany

[21] Appl. No.: 79,431

[22] Filed: Sep. 27, 1979

[30] Foreign Application Priority Data

Oct. 4, 1978 [DE] Fed. Rep. of Germany ..... 2843250

[51] Int. Cl.[3] ..... D04B 7/12

[52] U.S. Cl. ..... 66/194; 66/202

[58] Field of Search ..... 66/203, 190–195, 66/202

[56] References Cited

U.S. PATENT DOCUMENTS

| | | | |
|---|---|---|---|
| 2,284,454 | 5/1942 | Smith | 66/194 |
| 3,023,596 | 3/1962 | Hill | 66/194 |
| 3,254,510 | 6/1966 | Lesley | 66/195 |

*Primary Examiner*—Ronald Feldbaum

*Attorney, Agent, or Firm*—Omri M. Behr

[57] ABSTRACT

The process for preparing high density pile ware on a warp knitting machine wherein the pile loops formed from at least one thread system are knotted in by the stitches of the ground fabric structure formed from at least one other thread system includes at least one elastic thread. The high density pile ware includes an elastic thread having an elongation of at least fifty percent which may be woven into the ware or be utilized as an inlay, weft or straight inlay thread, thereby retaining the adjacent stitch wales and/or stitch rows in compression.

9 Claims, 6 Drawing Figures

HIGH DENSITY PILE WARE AND THE PROCESS THEREFOR

BACKGROUND OF THE INVENTION

1. Field of the Invention

The present invention relates to the preparation of pile ware on a warp knitting machine, and in particular, to the preparation of a high intensity pile ware utilizing at least one elastic thread.

2. Discussion of the Relevant Art

The prior art abounds with different types of machines which are capable of producing pile ware. Typical of these is German Pat. No. 2,262,076 issued to Karl Mayer on June 5, 1975 which discloses the use of several needles of a single bed warp knitting machine to produce a ground fabric structure and to lay the thread which forms the pile loops alternately around pile fingers and about the needles where they are knotted in. Generally, the pile loop forming threads are made of a fiber yarn and therefore, have a substantially larger diameter than the threads forming the ground fabric structure. This requires that a certain predetermined minimum needle separation must be maintained in order for the threads to move freely therearound. Furthermore, for reasons of stability, it is not possible to reduce the thickness and thereby the strength of the needles which is also a factor in determining the size of the stitch formed. Consequently, it is not only the stitch wale closeness but also the stitch row closeness and therefore, the closeness of the pile loops that are limited in present known machines.

Another German Pat. No. 1,188,784 issued to Manufacturers J. B. Martin et al on Mar. 11, 1965 discloses a machine that operates without the use of pile fingers. The ground fabric structure is produced on even numbered needles of the warp knitting machine and the threads utilized to form the pile loops are knitted alternately upon the even and then the odd numbered needles from which they are knocked over. Eliminating the pile fingers simplifies the construction of the warp knitting machine. However, the pile loop density attainable with this type of machine is even less than the density obtainable by the machine discussed hereinbefore.

SUMMARY OF THE INVENTION

An object of the present invention is to provide a process wherein pile ware can be produced with a higher pile density than has heretofore been known. In particular, it is desirable to provide a very high pile density in the same manner, with the same equipment wherein the pile loops are produced by utilizing those needles which are located between the needles used for the fabrication of the ground fabric structure.

Thus, the shortcomings found in the prior art, in the manufacturing of pile ware on a warp knitting machine may be overcome, according to the principles of the present invention, by utilizing at least one elastic thread in the ground fabric structure and to work this thread under a stretch or elongation of at least 50%. A conventional warp knitting machine may be utilized wherein the pile loops formed from one thread system are tied off by stitches of a ground fabric structure formed by at least one other thread system. The threads which are utilized in this stretched manner in the fabrication of pile ware cause, by virtue of their elasticity (return force), a close pulling together of neighboring stitch wales and/or neighboring stitch rows. This results in pile loops which are bound together by the stitches formed by the elastic threads and are disposed close to each other forming the desired high density pile ware.

Furthermore, by pulling together the threads in the longitudinal direction, the pile loops achieve a greater height. Thus, with the aforementioned technique it is possible to fabricate ware with a lower cut pile thread but provide a higher pile thereby reducing thread consumption.

It should be further noted that the elastic thread, because it is worked under stretch conditions has a much smaller cross section than in the unstretched condition. Even if these elastic threads cannot be produced in the desired thinness when unstretched, they are, during the knitting procedure so thin that they can be worked during the pile ware formation without the need for increasing the separation between the needles.

Another advantage is obtained in that the elastic threads provide a larger frictional force with respect to the other threads, thereby holding the pile loops more efficiently than heretofore.

Experimentation has shown that it is preferable to utilize elastic threads with an elongation of at least 100%. Optimum conditions appear to occur when the elongation is maintained between 150 to 200%. This increased elongation brings about correspondingly increased return strength (compression) and correspondingly increased pile density.

The aforementioned elongation of the elastic thread is achieved by means well-known in the art. Two general techniques may be employed. One technique causes the elastic thread to be wound onto the beam from the kreel under tension so that the thread on the beam is elongated the desired amount. Alternatively, the thread may be wound onto the beam from the kreel in the normal manner however, the speed of rotation of the beam delivering the thread is controlled at a rate less than the thread consumption at the point of stitch formation so that the increased tension provides the desired elongation.

The manner in which the elastic threads may be utilized in the ground fabric structure is varied to provide different types of ware. For example, the elastic threads may be used as weft or inlay threads, or warp inlay threads, partial weft insertion or full weft insertion threads. This permits pulling the threads together in the transverse direction which closes the distance between the stitches. The elastic threads can also be used as straight inlays in the warp direction, whereby the compressing forces operate in the longitudinal direction which would compress the stitch rows.

The elastic threads may also be used as stitch forming threads wherein their effect would vary and depend upon the particular binding utilized. In a pure pillar binding a pulling together or compression would occur only in the longitudinal direction. On the other hand, with a tricot stitch the compression or pulling together occurs both in the longitudinal and transverse direction. Moreover, the compression forces also act on the stitch itself so that the pile loop is pulled together and a particularly high pile density is achieved if the elastic thread is utilized in both a substantially longitudinally running thread system and in a substantially transversely running thread system, since in this manner both the stitch wales and the stitch rows are pulled together (compressed).

The elastic threads to be utilized in this procedure are well-known in the art. They must have a considerable elongation ability, preferrably at least 400%, and most suitably at least 600%. In some cases elongation of at least 1,000% may be required. These threads may be made of natural or synthetic elastomers. It is particularly advantageous to utilize threads of crosslinked polyeurathane such as "LYCRA," which is a registered trademark of Du Pont—. These threads have considerable strength and high degrees of elasticity.

A pile ware fabricated, in accordance with the principles of this invention, includes at least one ground fabric structure thread system of elastic thread wherein neighboring stitch wales and/or neighboring stitch rows are held elastically close together (compression). The high pile density achievable in the present process permits the use of thinner threads in the pile loop thread system while yielding a ware having high density pile loops. Thus, the close upper pile surface gives rise to new uses for the new pile ware. For example, it is possible to provide high density pile ware which can be comfortably worn close to or next to the skin. The pile ware produced in the present manner can be provided with a particular amount of thread tension thus providing the final ware with elasticity having a greater or lesser return force. This type of ware may be utilized for fabricating foundation garments.

Utilizing the process as set forth herein it is possible to obtain pile densities much greater than heretofore known in pile ware.

In order that the invention may be more fully understood it will now be described, by way of example, with reference to the accompanying drawing.

DESCRIPTION OF THE PREFERRED EMBODIMENTS

Figure 1:
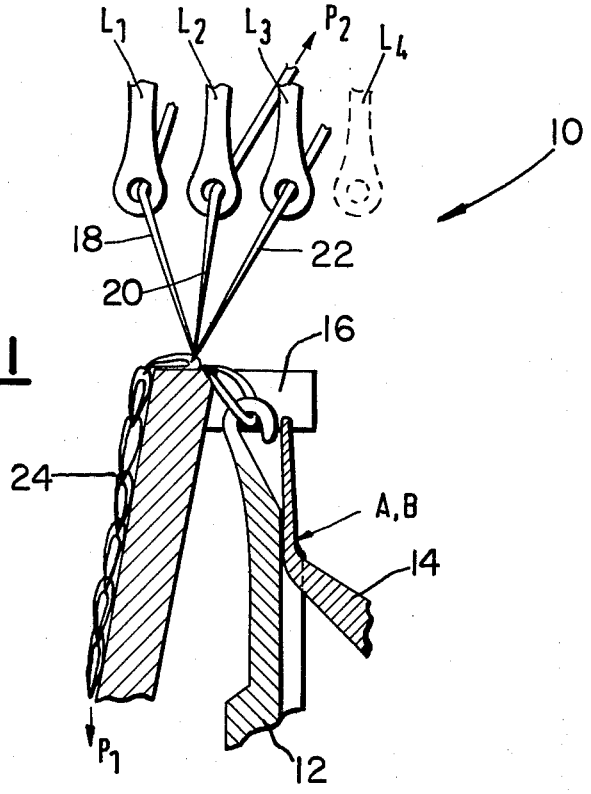
FIG. 1 is a partial schematic representation of the working area of a Raschel warp knitting machine.

Referring now to the drawings, and in particular to FIG. 1 which discloses the working area of a conventional Raschel warp knitting machine. The warp knitting machine 10 includes a needle bar, not shown, having a plurality of slider needles 12 affixed thereon, in a conventional manner. The slider needle 12 includes conventional sliders 14 associated therewith coupled to the warp knitting machine driving source, not shown. The machine also includes a knockover trick plate 16 and four guidebars, not shown, which have a plurality of guides affixed thereon in a conventional manner. The guidebars, each represented by a singular guide are designated $L_1$, $L_2$, $L_3$, and $L_4$. The guidebars $L_1$, $L_2$ and $L_3$ each carry the threads of thread systems 18, 20 and 22. It is understood that each of the guidebars have affixed thereon a plurality of guides although only one of each is depicted in FIG. 1. Since guidebar $L_4$ is not utilized at the present time it is shown in dotted lines.

Slider needle 12 and slider 14 form the working needle, which are the even numbered needles and are designated as A. These needles are utilized for the formation of stitches of the ground fabric structure whereas, the thread for the formation of the pile loops is merely laid around and thereafter knocked over the odd numbered needles designated as B. The pile ware 24, thus formed, is pulled downwardly, in a conventional manner, with a force $P_1$. The threads of thread systems 18, 22 and 24 are held under a breaking force $P_2$, in a conventional manner.

Figure 2:
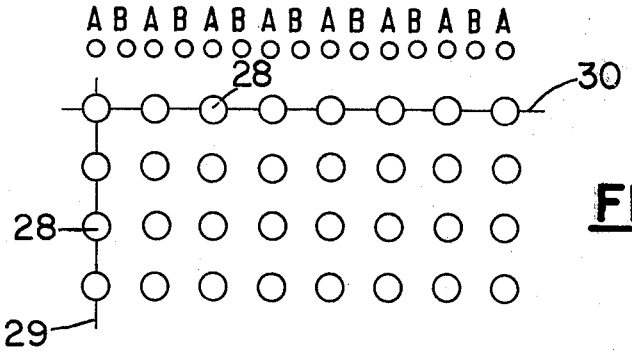
FIG. 2 is a pictorial representation of a plan view of pile ware during the formation step.
Figure 3:
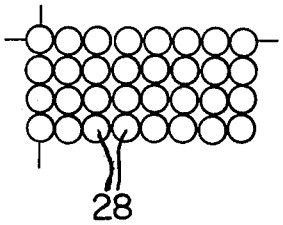
FIG. 3 is a pictorial representation of the plan view of pile ware after the formation thereof.

FIG. 2 is a pictorial representation appearing under the needle bed showing needles A and B indicating the position of the pile loops 28 after their knockover from needle B. The spaces in the transverse direction as shown in FIG. 2 result in the stitch wale separation of the ground fabric structure because of the irreducible distance between the needles (machine fineness) and the fact that the procedure for fabricating pile ware requires the knitting about every other or A needles. The spacing in the longitudinal direction is caused by the irreducable size of the stitch wales and thus, sets the predetermined spacing between the stitch rows. Pictorially, the thread system 29 is shown as it appears in the longitudinal direction and thread system 30 is shown as it appears in the transverse direction, which in the preferred embodiments are provided with elastic threads. This insures that the pile ware after being released from the tension applied is pulled together not only in the longitudinal direction but also in the transverse direction, as shown in FIG. 3. This yields an extremely high pile density heretofore unknown.

During the working procedure a substantial stretching of the elastic threads is preferred. This is achieved by providing that the threads be prewound under tension and/or providing a breaking force $P_2$ to the threads relative to the pulling force $P_1$ by either using a conventional controlling means for the drive on the warp beam for the elastic threads or by utilizing self-regulating breaking mechanism applied to the warp beam shaft.

The elongation percentage of the elastic threads is defined as the ratio of the amount of increased thread length due to stretching thereof divided by the unstretched thread length times 100. This may be represented algebraically as follows:

$$\text{Percent Elongation} = (\Delta L/L) \times 100$$

Figure 4:
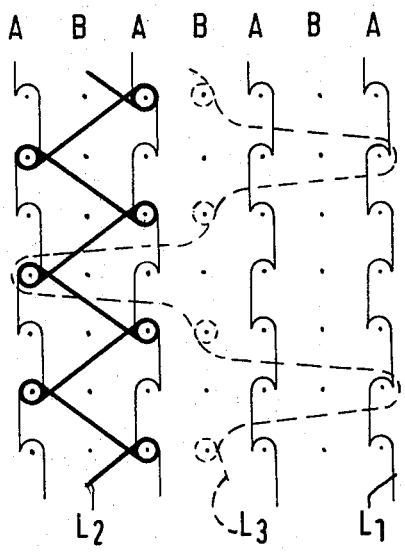
FIG. 4 is a lapping diagram for a first embodiment of pile ware fabricated according to the principles of the present invention.

The warp knitting machine 10 as shown in FIG. 1 can, for example, be operated in accordance with the lapping diagram disclosed in FIG. 4. The guidebar $L_3$ carries the pile loop thread system 22 which alternately lays the threads around the A needles and B needles skipping over a pair of A and B needles so that the pile loops appear on one side of the finished ware (right side). The guidebar $L_2$ lays an elastic thread alternately about adjacent needles A and guidebar $L_1$ utilizes normal threads and provides the pillar stitches by laying about the A needles only. The pile ware thus provided has a tension not only in the longitudinal direction but also in the transverse direction.

Figure 5:
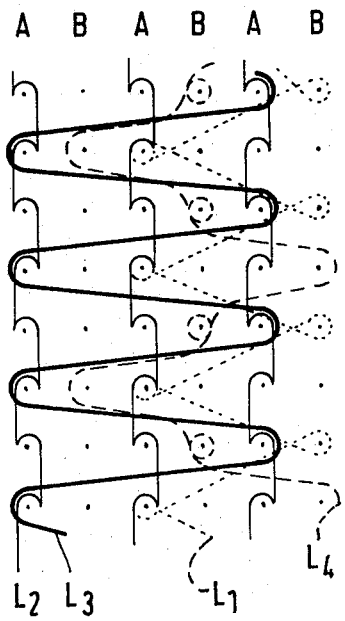
FIG. 5 is a lapping diagram for a second embodiment of pile ware.

FIG. 5 discloses another embodiment in which guidebars $L_1$ and $L_4$ provide pile loops on both sides of the pile ware. Guidebar $L_3$ provides a thread system of elastic thread which is bound in as an inlay in a backwards and forwards direction on small transverse sections. These warp inlay threads are knotted in by the pillar stitches which are produced by normal threads used in the thread system of guidebar $L_2$.

Figure 6:
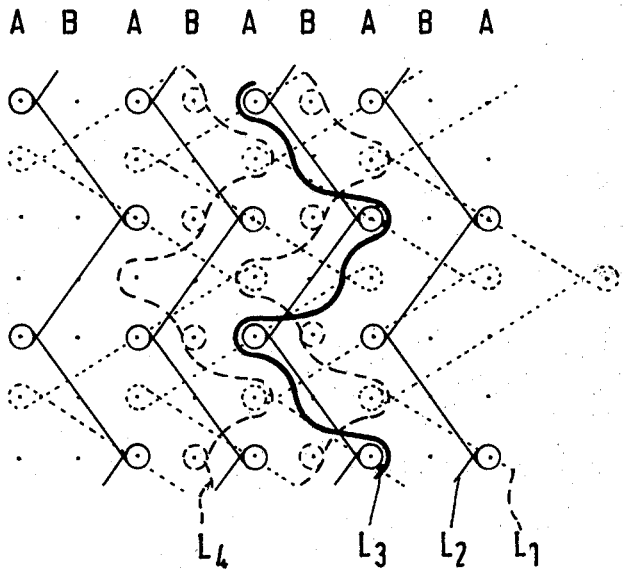
FIG. 6 is a lapping diagram for a third embodiment of pile ware.

FIG. 6 discloses a still further embodiment in which guidebar $L_4$ is utilized again to provide pile loops which appear on one side of the finished ware or goods. The guidebars $L_1$ and $L_2$ provide the normal ground fabric structure from normal threads while guidebar $L_3$ utilizes an elastic thread system to provide a straight inlay in the warp.

Although only three embodiments utilizing elastic threads have been disclosed herein it is understood that elastic threads may be utilized in numerous designs and positions to create pile ware and/or other ware heretofore unknown.

It will be understood that various changes in the details, materials, arrangement of parts and operating conditions which have been herein described and illustrated in order to explain the nature of the invention may be made by those skilled in the art within the principles and scope of the present invention.

Having thus set forth the nature of the invention, what is claimed is:

1. A process for preparing pile ware on a needle bed of a warp knitting machine wherein the pile loops formed from one thread system are tied off by stitches of a ground fabric structure formed by at least one other thread system, the improvement which comprises providing at least one ground fabric structure thread which is elastic, said elastic thread having an elastic elongation limit of at least 400% and said elastic thread being worked with an elongation of at least 100% and forming the pile loops by utilizing those needles that are disposed between the needles used for the fabrication of the ground fabric structure.

2. The process according to claim 1 wherein said elastic thread is provided with an elongation of between 150 and 250%.

3. The process according to claim 1 wherein at least one elastic thread is utilized in said second thread system.

4. The process according to claim 1 wherein at least one elastic thread is utilized as an inlay thread.

5. The process according to claim 1 wherein at least one elastic thread is utilized as a straight inlay thread.

6. The process according to claim 1 wherein at least one elastic thread is utilized as a weft thread.

7. The process according to claim 1 wherein at least one elastic thread is utilized as a stitch forming thread.

8. The process according to claim 1 wherein elastic threads are used in the substantially longitudinally running thread system and in the substantially transverse running thread system.

9. The process according to claim 1 wherein said elastic threads are fabricated from polyeurethane.

* * * * *